US007007314B2

(12) United States Patent
Courouzos

(10) Patent No.: US 7,007,314 B2
(45) Date of Patent: Mar. 7, 2006

(54) COMBINATION BABY CHANGE TABLE AND BATH SUPPORT

(75) Inventor: George Courouzos, 37 Ingrams Road, Research, Victoria (AU) 3095

(73) Assignee: George Courouzos, Research, Victoria (AU)

( * ) Notice: Subject to any disclaimer, the term of this patent is extended or adjusted under 35 U.S.C. 154(b) by 0 days.

(21) Appl. No.: 10/685,936

(22) Filed: Oct. 15, 2003

(65) Prior Publication Data

US 2004/0139543 A1 Jul. 22, 2004

(30) Foreign Application Priority Data

Oct. 17, 2002 (AU) ..... 2002952141

(51) Int. Cl.
*A47K 3/024* (2006.01)

(52) U.S. Cl. ..... 4/572.1; 4/659

(58) Field of Classification Search ..... 4/572.1, 4/586, 587, 659

See application file for complete search history.

(56) References Cited

U.S. PATENT DOCUMENTS

| | | | | |
|---|---|---|---|---|
| 1,512,522 A | * | 10/1924 | Colburn | 4/548 |
| 1,724,479 A | | 8/1929 | Havener | |
| 1,812,971 A | * | 7/1931 | McCandless | 4/551 |
| 1,883,660 A | * | 10/1932 | Feldman | 4/572.1 |
| 2,698,948 A | * | 1/1955 | Levitt | 4/551 |
| 2,715,736 A | | 8/1955 | Pearlson | |
| 2,719,306 A | * | 10/1955 | Levitt | 4/551 |
| 5,491,850 A | | 2/1996 | Kiester | |
| 6,049,928 A | | 4/2000 | Helmsderfer | |

FOREIGN PATENT DOCUMENTS

| | | |
|---|---|---|
| DE | 28 56 169 A1 | 12/1978 |
| DE | 32 46 565 | 12/1982 |
| DE | 32 46 566 C1 | 12/1982 |
| DE | 4327819 | 2/1994 |
| EP | 0111888 | 6/1984 |
| EP | 0288047 | 10/1988 |
| FR | 2 810 221 | 6/2000 |
| WO | WO 99/35947 | 7/1999 |
| WO | WO 02/09555 A1 | 7/2002 |

* cited by examiner

*Primary Examiner*—Justine R. Yu
*Assistant Examiner*—Huyen Le

(57) ABSTRACT

A device for use with bathing and changing a baby includes a structure for removably supporting a baby bath. In one embodiment, the structure comprises a panel having a cut out for the baby bath and includes side rails for slidably mounting a change table that can slide over the baby bath from a position beside the baby bath. Additionally, at least one work table is also mounted by the panel structure between the change table and the baby bath. Also, the work table may also be slidable over the baby bath. In one aspect, the panel structure includes a support framework that is at least height adjustable for supporting the device over a household bath tub. Advantageously, the device saves space within a bathroom as it is locatable over a household bath tub. Moreover, it also allows for safe handling of a baby which can be lifted from the baby bath and immediately placed on the change table located next to the baby bath. The change table can then be easily slid across to cover the baby bath.

11 Claims, 9 Drawing Sheets

COMBINATION BABY CHANGE TABLE AND BATH SUPPORT

CLAIM OF PRIORITY

This U.S. patent application claims priority to Australian Patent No. 2002952141, entitled "Combination Baby Change Table and Bath Support" filed Oct. 17, 2002, which is hereby incorporated by reference herein.

BACKGROUND OF THE INVENTION

1. Field of the Invention

The present invention relates to a device for use with bathing and changing a baby, wherein the device provides means for supporting a baby bath combined with a facility for supporting a baby for drying and changing its clothing.

2. Description of the Related Art

Change tables for babies that also support a baby bath are known. Generally, these are stand alone structures that are relatively portable and thus movable from room to room to suit a carer's needs. However, such independent structures may be quite inconvenient because of the space they occupy in a room, particularly a bathroom of generally relatively small size, which is a usual use location. In such portable change table structures, the baby changing part may be a pivotally mounted table lid that normally covers the baby bath and which is pivoted and latched (for safety reasons) away from the baby bath when the bath is to be used. A problem with such structures is that upon removal of a baby from the bath, the change table lid must be unlatched and then pivoted down to cover the bath, usually with the carer using only one hand because the other is occupied in holding the baby. Otherwise, the baby may initially be placed on another surface to enable the carer to unlatch and pivot the change table lid using both hands before picking the baby up to place it on the change table. It is evident that, in addition to the inconvenience of such change table structures, there is a likelihood of a baby being placed in a situation of increased risk to its safety.

SUMMARY OF THE INVENTION

The present teachings seek to provide a device for use with bathing and changing a baby that does not inconveniently occupy space in a room and which is convenient to use without compromising the safety of a baby.

According to one embodiment of the invention, there is provided a device for use with bathing and changing a baby comprising a structure for supporting a baby bath and a table top for supporting a baby (hereinafter "change table") slidably mounted on said structure for movement relative to a baby bath supported by said structure from a position next to the baby bath to a position over the baby bath, said structure including supports for supporting the device over a household bath tub.

In one aspect, the device of the invention, being locatable over the bath tub of a household, will be positioned where it does not inconveniently occupy the space in the room that contains the bath tub. In fact, the device will be located in a natural and normal environment for its use (that is, a bathroom) where advantageously it will be proximate to the bath tub's or vanity basin's water supply taps for filling the baby bath, for example via a hose attached to such a tap, and the convenience of emptying the baby bath contents via its drain plug or by tipping its contents into the household bath tub to drain away. Additionally, it will be located in a wet area whereby splashing of the baby bath water will be of no concern. The device is also convenient to use without compromising a baby safety in that the baby can be lifted from the bath and immediately placed on the change table located closely next to the baby bath, that is, a carer does not have to manipulate any latches or pivot a change table top whilst holding the baby. Once the baby is placed on the change table, that table is then easily slid across to cover the baby bath, thereby adding to the safety of the baby environment.

In another aspect, the supports of the structure for supporting the baby bath are adjustable for varying the height of the change table of the device over a household bath tub. This adds to the convenience of use of the device in that it can be adjusted to suit the height of a carer and thereby lessen strains that may be imposed on the carer's back or legs due to bending over and lifting or supporting a baby.

In still another aspect, the device includes a further table top (hereinafter "work table") mounted on said structure and located between the change table and a baby bath supported by said structure. The work table may be attachable to the structure, for example by clips, for location adjacent the baby bath. In addition, the work table is slidably mounted on said structure and is movable relative to the baby bath from a position adjacent the baby bath to a position covering the baby bath. The work table is for supporting accessories (for example, towels, nappies, etc.) and for safely covering the household bath tub when a baby is on the change table beside or over the baby bath.

Advantageously, this added work table feature increases the safety and convenience of use of the device by providing a close by surface for readily accessing items placed thereon for use both during washing of a baby in the baby bath (for example flannel, soap, shampoo, etc.) and upon removal of the baby from the bath (for example towels, powder, nappies, clothing, etc.). It also provides added safety in that this work table, in its normal use location adjacent the baby bath, covers the household bath tub and thereby minimizes any risk of the baby falling into the household bath tub from the baby bath or from the change table. It also provides a convenient work surface for folding towels, nappies, etc.

In one aspect, the work table includes a cut-out portion at its end adjacent the baby bath which is shaped similar to the peripheral outline of the end of the baby bath such that the work table can reside closely adjacent that end and the near sides of the baby bath whilst ensuring that the baby bath is fully accessible.

In one embodiment, the change table and the work table (if slidably mounted on said structure) may be arranged such that both tables can be slid at the same time to be positioned adjacent the baby bath, the work table can be slid by itself to be positioned adjacent the baby bath and the change table cannot be slid by itself to be positioned adjacent the baby bath unless the work table is already so positioned.

Thus, in one aspect, the work table effectively provides a surface for safety and convenience which in normal use of the device remains stationary and extends away from the edge of the baby bath and over the household bath tub. The change table, located above the work table, is slidable between a position over the work table to a position towards or over the baby bath.

Conveniently, the device includes an even further table top (hereinafter "second work table") which may also be slidably mounted to said structure and located between the change table and the first described work table. This second work table may also be slidably movable such that it may be located over or adjacent the baby bath. Effectively, this second work table, instead of the change table, can be slid to cover at least a portion (for example about half) the baby bath as soon as the baby has been removed and placed on the change table. Alternatively, the change table and second work table together can be slid across to a more convenient location for the change table, and the second work table then slid further across over the baby bath. This provides added safety in that sliding of the change table with the baby on it to a position over the baby bath is not necessary. It also provides for an increased work table area of greater convenience in that a work table area on both sides of the change table is now provided. With this added feature, that is, a second work table, the first described work table, when slidably mounted, assists easy storage of the device or access to the household bath without necessarily removing the device therefrom. With a device according to the invention having two work tables, both work tables may be non-slidably mountable, or one or both of the work tables may be slidably mounted.

In one embodiment, the structure for supporting the baby bath includes mounting means for mounting the device to a wall adjacent a household bath tub, wherein the device is pivotable relative to the mounting means for movement from a storage position against the wall to a use position over the household bath tub.

The above described mounting feature allows the device to be "folded up" and effectively "put away" (that is, the device is pivoted away from the household bath tub into a storage position against the wall) so that the household bath tub is available for normal use.

In one aspect, the structure for supporting a baby bath is a planar body having an aperture within which the baby bath is locatable to be supported by the planar body. Thus, the baby bath is preferably removable from the structure.

In one embodiment, the structure for supporting the baby bath, be it a planar body or some other structure, can be of a standard size such that the change table and the work table can be slidably mounted thereon whereby the change table and work table may also be of a standard size and yet the structure can be fitted to differently sized household bath tubs. The fitability of the device to differently sized household bath tubs is possible by way of the standard sized structure being removably attached to a support framework (which provides the supports of the device) which, as well as being height adjustable, is also adjustable lengthwise and widthwise for locating and supporting the device over household bath tubs of varying sizes.

For a better understanding of the invention and to show how it may be carried into effect, various embodiments thereof will now be described, by way of non-limiting example only, with reference to the accompanying drawings.

DETAILED DESCRIPTION OF THE PREFERRED EMBODIMENT

Figure 1:
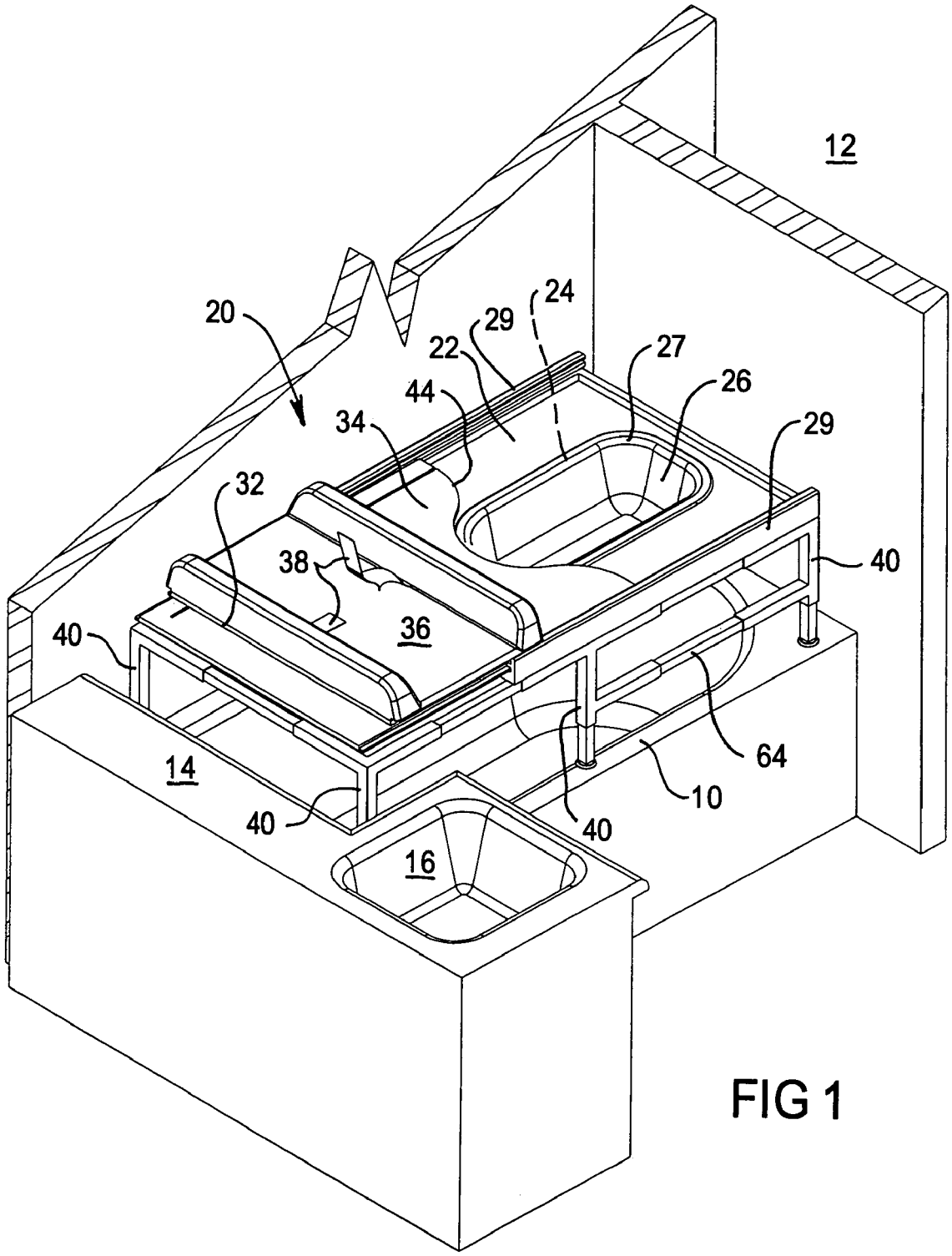
FIG. 1 shows a device according to an embodiment of the invention installed over a household bath tub.

With reference to FIG. 1, a household bathroom typically includes a bath tub 10 (which may be installed in a surround) in proximity to a shower recess 12 and a vanity unit 14 containing a sink 16. A device 20 for use with bathing and changing a baby is located over the bath tub 10. The device 20 includes a structure 22 substantially in the form of a planar body or panel having an aperture 24 within which a baby bath 26 is locatable to be removably supported by the panel 22. Typically, the baby bath 26 will include a rim 27 which contacts the panel 22 around the periphery of the aperture 24 for the baby bath 26 to be supported, although other arrangements are possible, for example the panel 22 may include supports extending underneath to support the baby bath 26 by its base.

Figure 2:
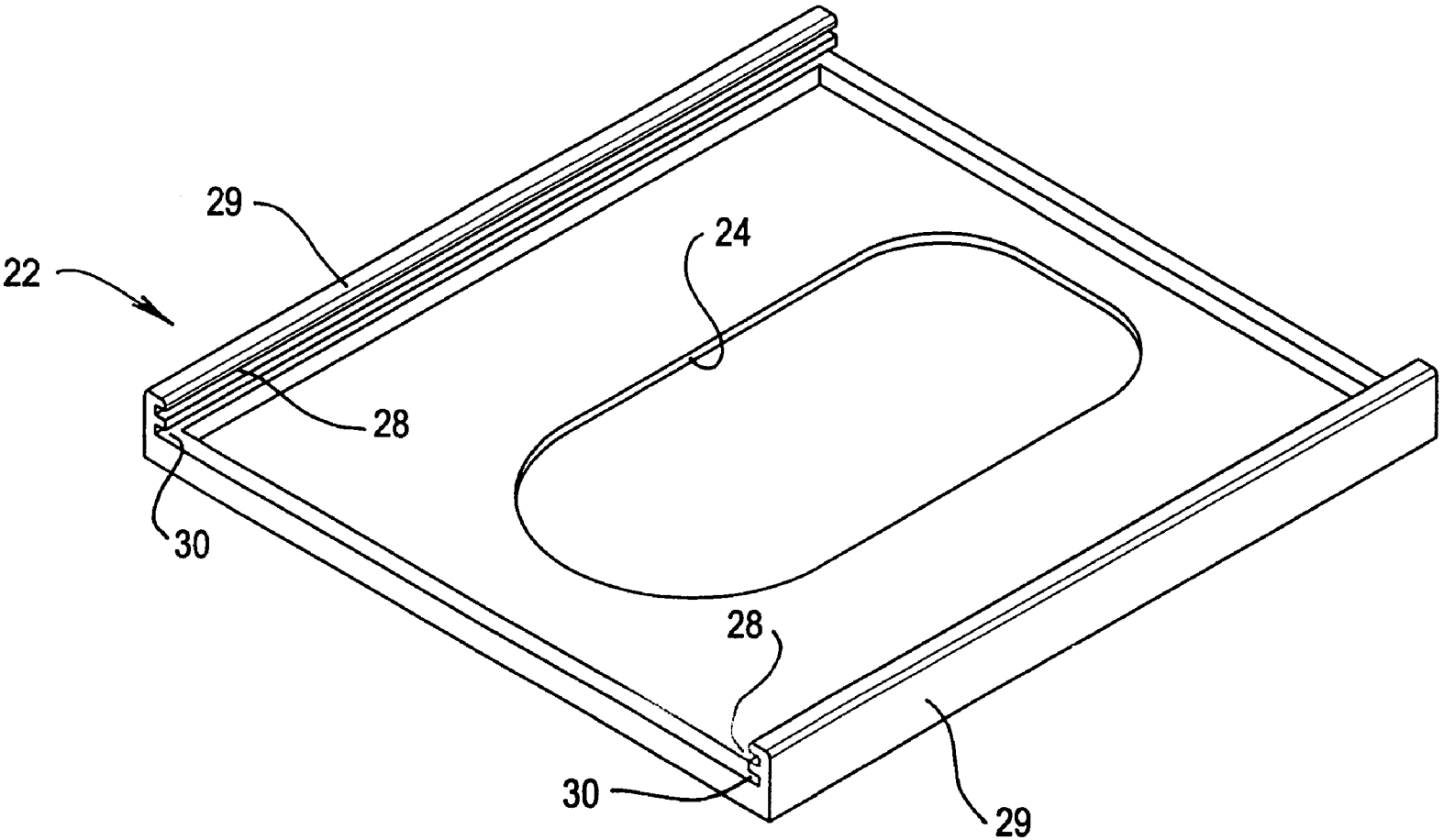
FIG. 2 illustrates a component of the FIG. 1 device, namely a structure for removably supporting a baby bath.

The panel structure 22 (see FIG. 2) includes opposite side rails 29 which each include two slideways 28, 30 along opposite sides lengthwise of the baby bath aperture 24 for slidably mounting a table top 32 (see FIGS. 1 and 3) for supporting a baby (herein described as the change table 32) and a further table top 34 (herein described as a work table 34). Change table 32 is slidably mounted via slideway 28 and work table 34 is slidably mounted via slideway 30 such that it is located between the change table 32 and a baby bath 26 when supported by the panel structure 22.

The change table 32 includes a padded top 36 having side ridges (for example, a thick foam padded vinyl mat) and a belt 38 (fastenable for example with Velcro™) for the comfort and safety of a baby.

The panel structure 22 is mounted on a framework 42 (see FIG. 6) which, as shown in FIG. 1, provides supports 40 for locating and supporting the device 20 over the household bath tub 10.

Figure 3:
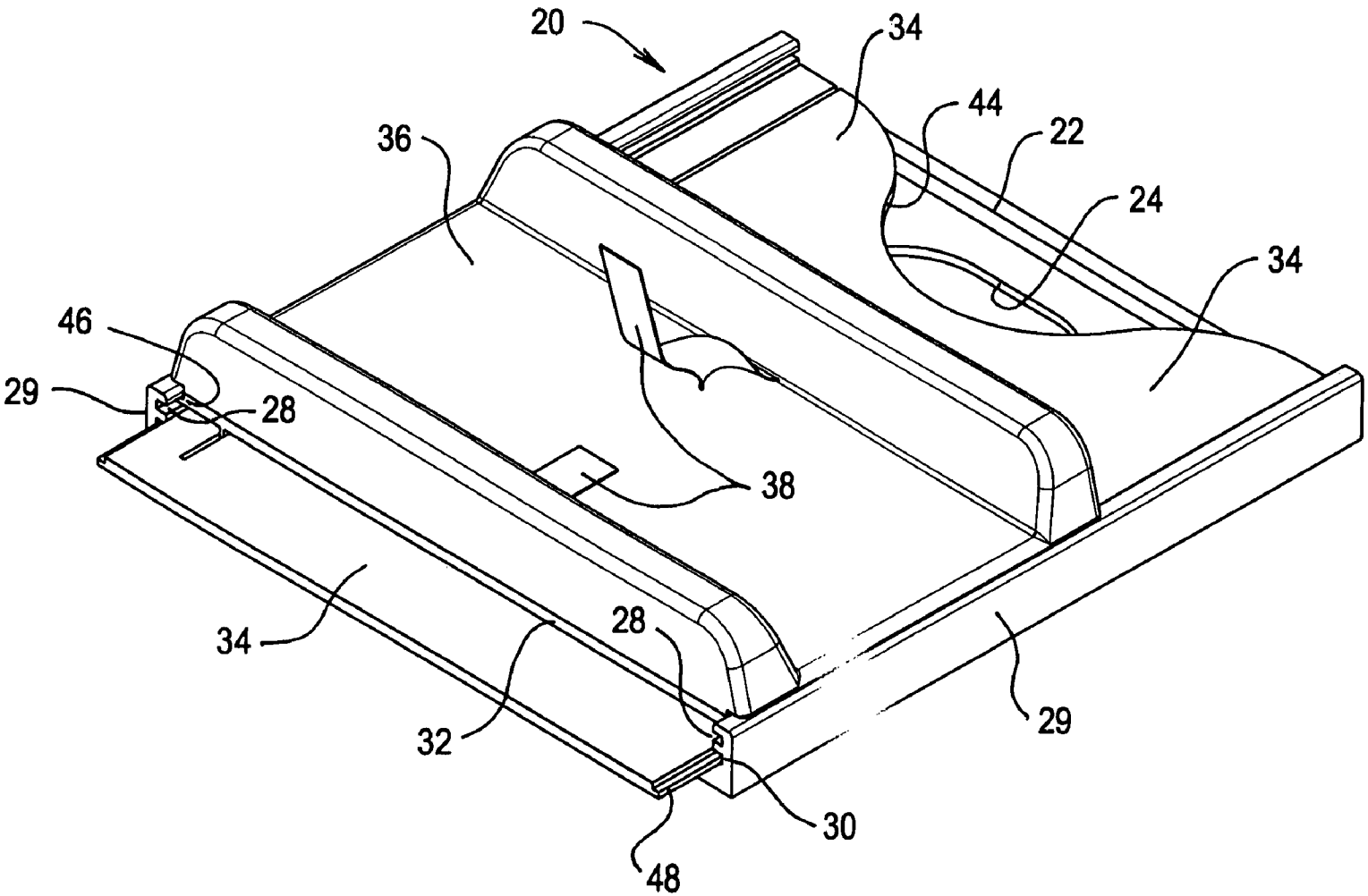
FIG. 3 illustrates in perspective the device of FIG. 1 without its supports.

As can be seen in FIGS. 1 and 3, the work table 34 is longer than the change table 32 and includes a U-shaped cut-out 44 at its end adjacent the baby bath aperture 24 to ensure that the baby bath 26 is fully accessible.

In use of the device 20, the work table 34 and change table 32 may be positioned as shown in FIG. 1 whilst a baby is bathed in the baby bath 26. The baby may then be transferred from the bath 26 directly on to the change table 32. This table 32 with the baby thereon may then be slid to a position towards or over the baby bath 26. The work table 34 is positioned over the household bath tub 10 to safely cover it whilst the baby is handled on the change table 32. The work table 34, in addition to its safety function in covering the bath tub 10, also provides a convenient surface for placement of various accessories for use with the baby.

Figure 4:
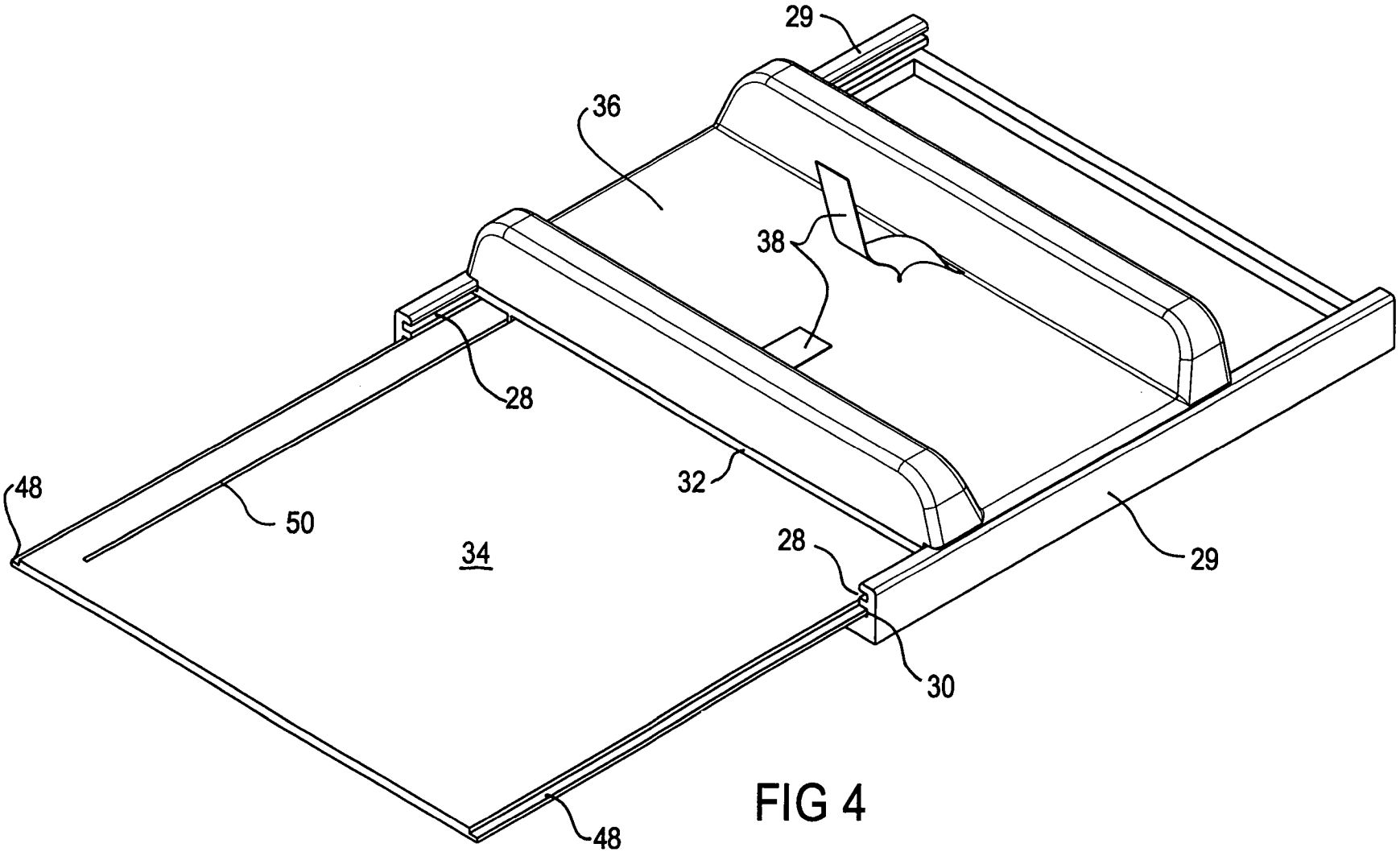
FIGS. 4 and 5 show the device shown by FIG. 3 with different positionings of its change table.
Figure 5:
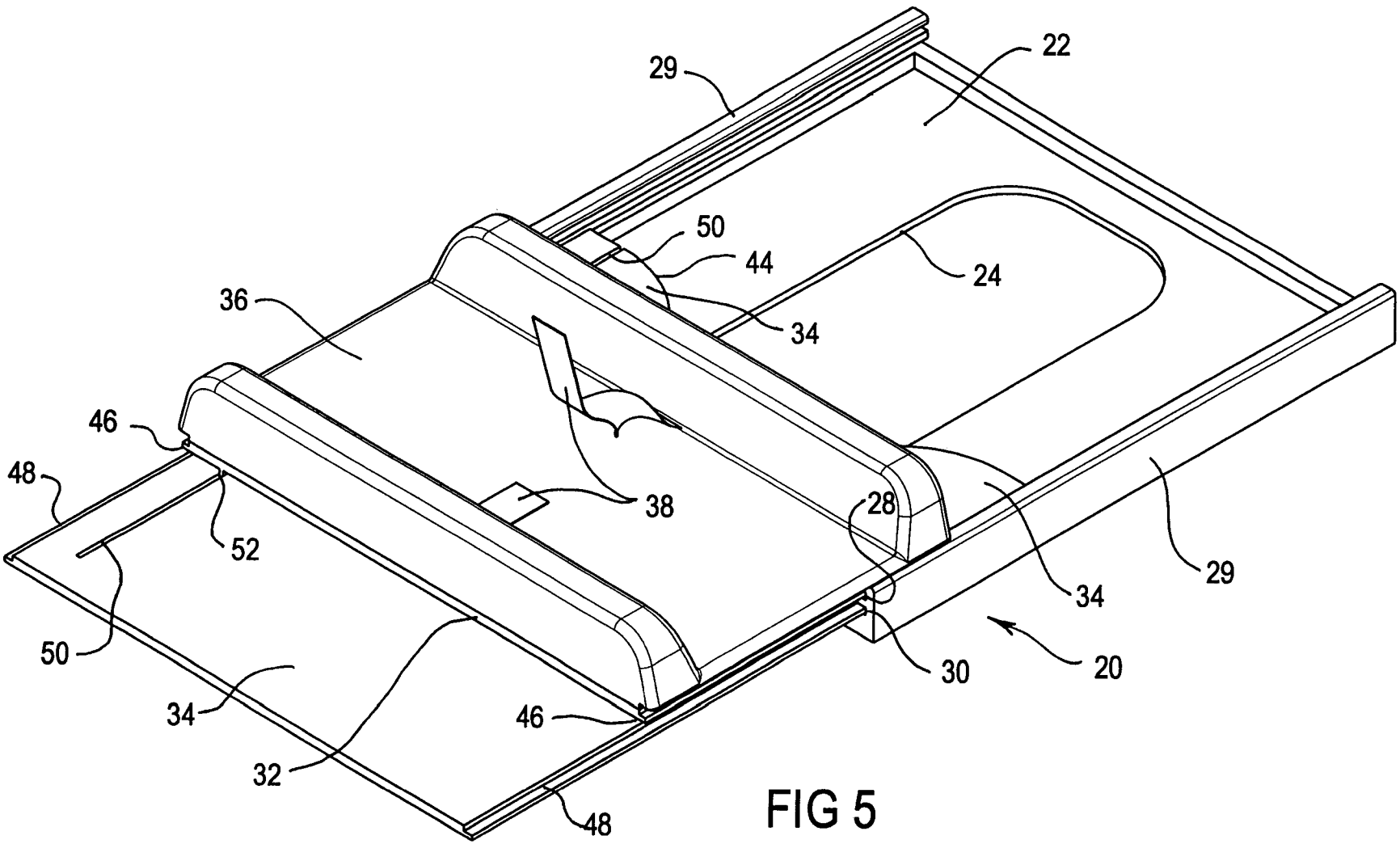

The slideways 28, 30 of the side rails 29 of the panel structure 22 may be simply channels within which tongue formations 46, 48 (see FIG. 3) respectively along the change table 32 and work table 34 reside to slide therealong. Other sliding arrangements are also possible including roller or ball bearing arrangements, as would be known by appropriately skilled persons in this field. FIGS. 4 and 5 illustrate a range of movement for the change table 32 from a position over the baby bath (FIG. 4) which exposes a substantial portion of the work table 34, to a position over the work table 34 (FIG. 5). As would be known, appropriate stops (not shown) would be included to define the end limits of the slidable movement of both the work table 34 and the change table 32 relative to the panel structure 22. Such stops could be provided by the ends of slideways 28, 30 in the side rails 29. FIG. 5 illustrates that with the work table 34 extended to its outermost limit beyond the ends of side rails 29, because of the cut-out 44 an adequate length of the tongue formations 48 remain in the slideways 30 to still support the extended work table 34. Added support for the work table 34 in its extended position may be provided by a rest on the framework 42 (not shown). Such a rest may include a roller to assist the sliding of the work table 34.

A device 20 according to the invention may also be set up for either left-handed or right-handed use relative to the baby bath aperture 24. The work table 34 may also include a slot 50 in its upper surface and the change table 32 may include a guide pin or blade 52 attached to its undersurface for movement within and along the slot 52 to ensure tracking alignment of the change table 32 relative to the work table 34. This tracking arrangement 50–52 may be unnecessary if the change table 32 and work table 34 are slidably mounted to the panel structure 22 by high quality bearing structures, for example that incorporate roller bearings.

Figure 9:
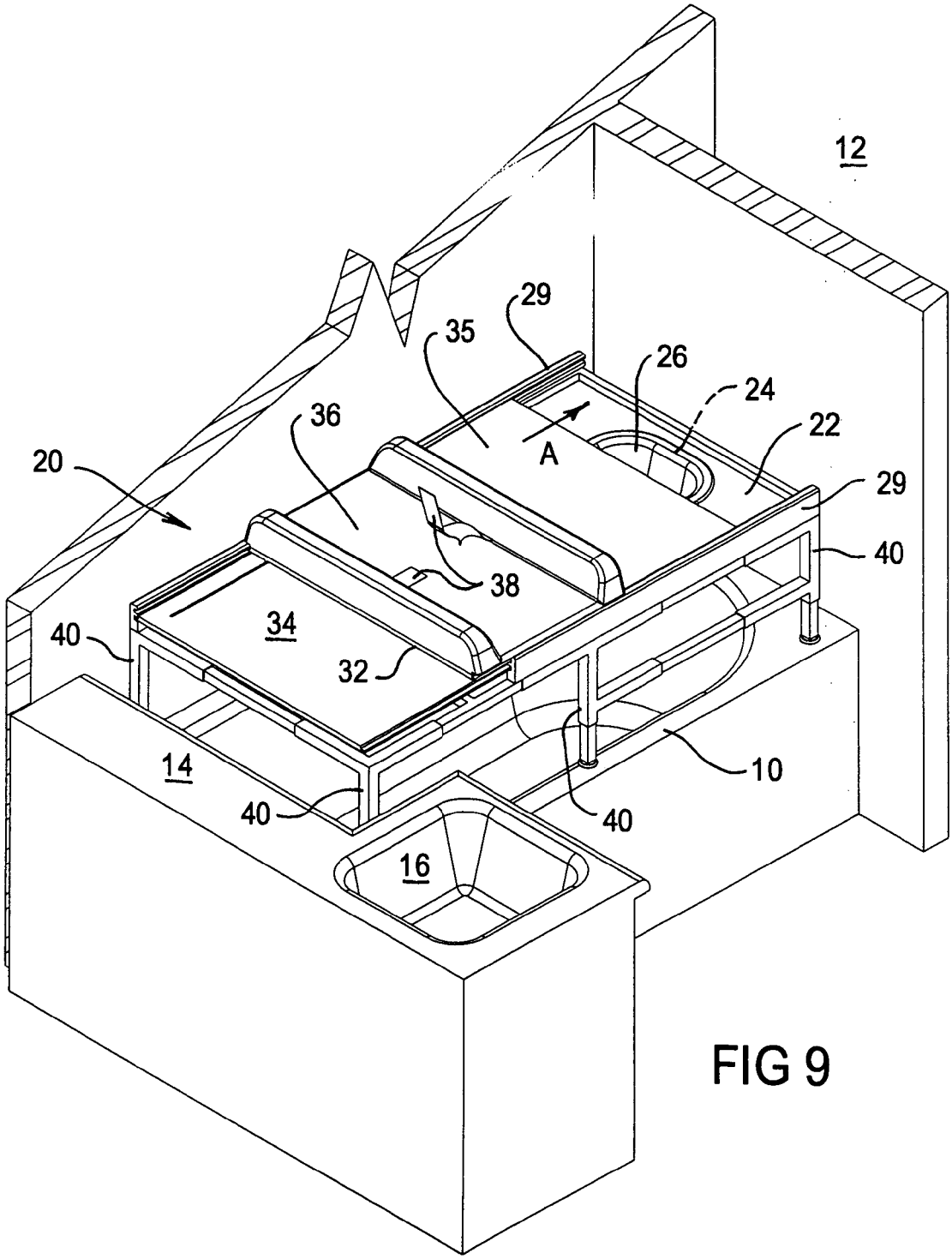
FIG. 9 is similar to FIG. 1 and shows a device according to an embodiment of the invention that includes two work tables.

FIG. 9 is a view similar to FIG. 1 but showing the device 20 as having two work tables, namely work table 34 as in FIG. 1 plus a second work table 35 (note that the same reference numerals are used in FIGS. 1 and 9 to denote corresponding components). The second work table 35 may be slidably mounted on rails 29 of structure 22 and located between the change table 32 and the first work table 34. It is slidably movable from a location adjacent the baby bath 26 to a location over the baby bath as indicated by arrow A (FIG. 9 illustrates the second work table 35 partially moved across the top of the baby bath 26). Alternatively the second work table 35 can be mounted on and under the change table 32 to be slidable relative thereto to function as described above.

The provision of the second slidable work table 35 provides added safety in that a baby can be removed from the baby bath 26 and placed on the change table 32 and then the work table 35 instead of the change table 32 be moved to cover the baby bath 26. Thus the change table 32 with the baby on it need not be moved. Alternatively the change table 32 and second work table 35 together may be moved partially across the baby bath until the change table 32 is conveniently located for the carer and then the second work table 35 moved further across to cover the baby bath. The second work table 35 also provides added convenience in that another work surface is provided next to the change table 32. Thus the work table 35 provides a work surface on the right side (as seen in FIG. 9) of the change table 32 and the work table 34 provides a work surface on the left side. A possible modification for a device 20 as illustrated in FIG. 9 is that the work table 34 need not be slidably mounted.

Figure 6:
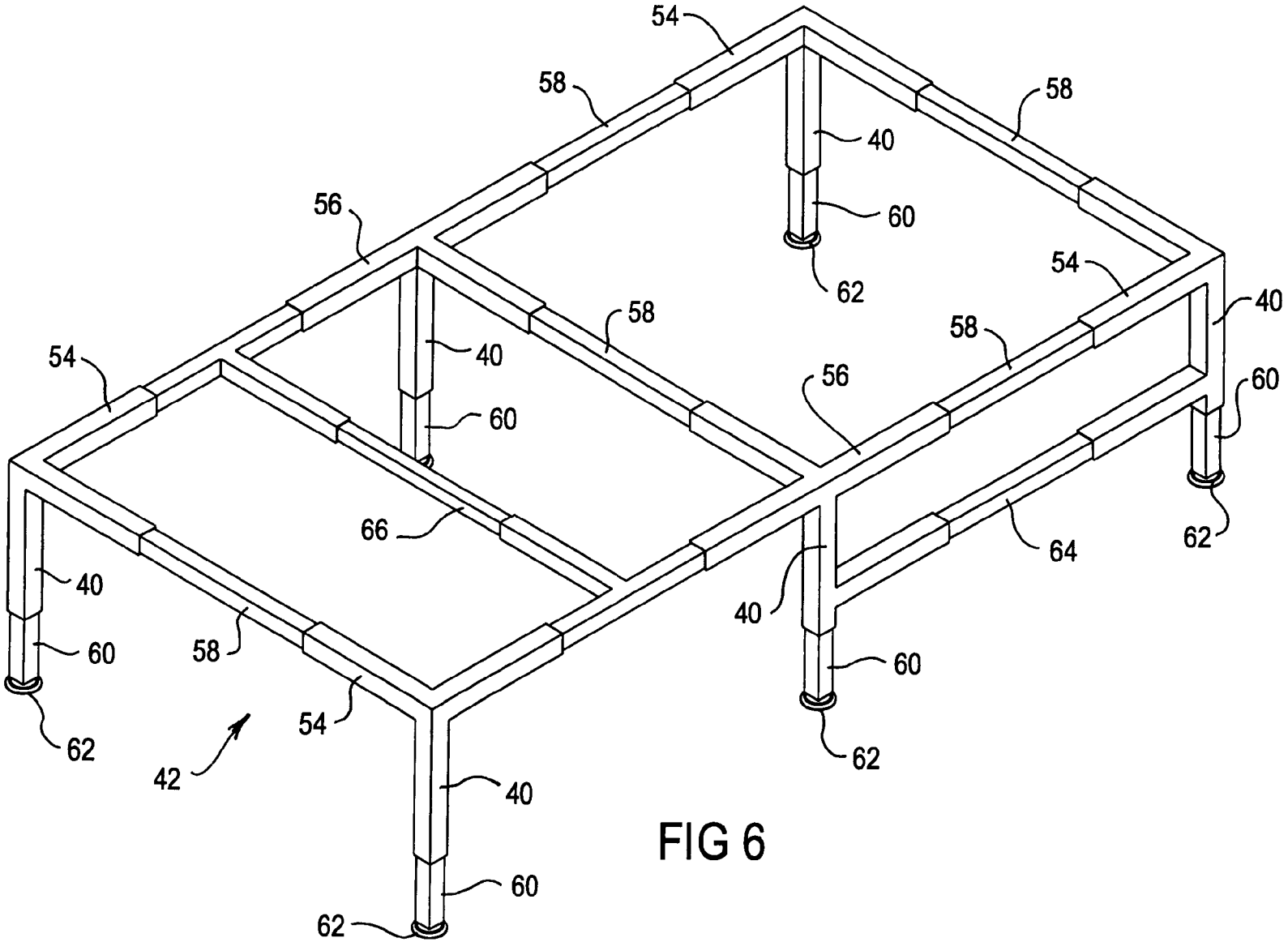
FIG. 6 shows a support framework of the device of FIG. 1.

The fully adjustable frame 42 (see FIG. 6) that provides the supports 40 comprises corner brackets 54 and intermediate brackets 56 with telescopic sections 58 therebetween. Suitable clamping screws (not shown) are associated with the brackets 54 and 56 to clamp the telescopic sections 58. Thus the frame is adjustable lengthwise and widthwise to suit differently sized household bath tubs 10. After adjustment of frame 42 to suit a particular household bath tub, the structure 22 can then be removably fastened thereto by suitable screws, as would be well known by an appropriately skilled person. The supports 40 also comprise telescopic sections 60 and thus the frame 42 is also adjustable heightwise such that a carer can position the device 20 at a height which is most comfortable for him or her. The supports 40–60 of the illustrated frame 42 include feet in the form of suction caps 62 for attachment to the bath tub 10 or its surround. However persons skilled in this field will understand that other arrangements are possible to ensure secure attachment or support of the device 20 to or by the household bath tub 10 via the frame 42. Such persons will also appreciate that the panel structure 22 can be attached to the frame 42 in any suitable manner. The frame 42 as illustrated by FIG. 6 may also incorporate stabilizing bars such as 64, 66 (note that bar 64 provides a convenient towel rail).

As an alternative to the frame 42, suitable supports similar to 40–60 may be mounted directly on to the panel structure 22 so as to be pivotable relative thereto such that they may be folded away against the panel structure 22 for storage of the device 20. Persons skilled in this field will have knowledge of many different types of pivotal mountings and thus will be able to choose one that is suitable.

Figure 7:
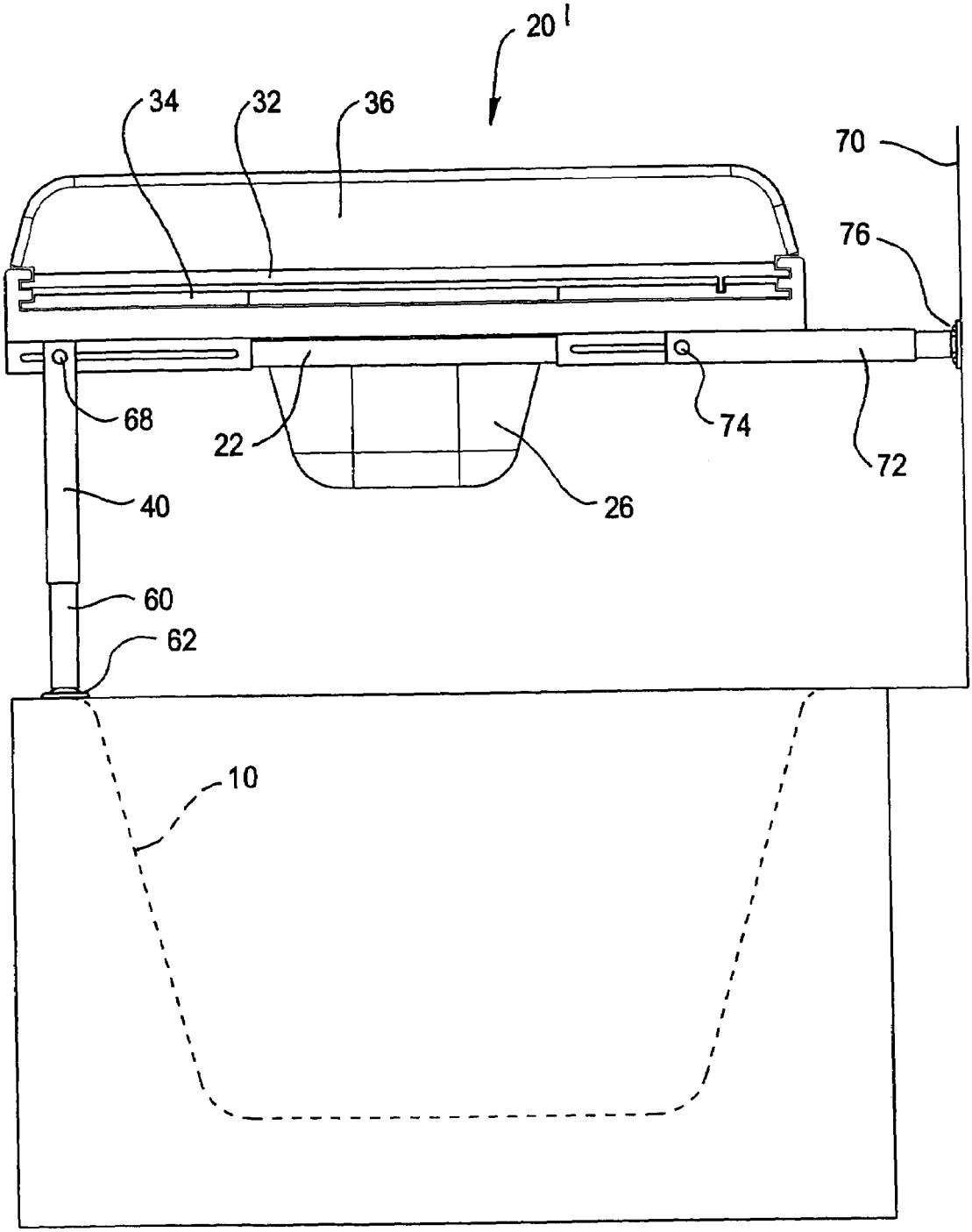
FIG. 7 shows in end view a device according to another embodiment of the invention which is pivotally mounted for storage against a wall.
Figure 8:
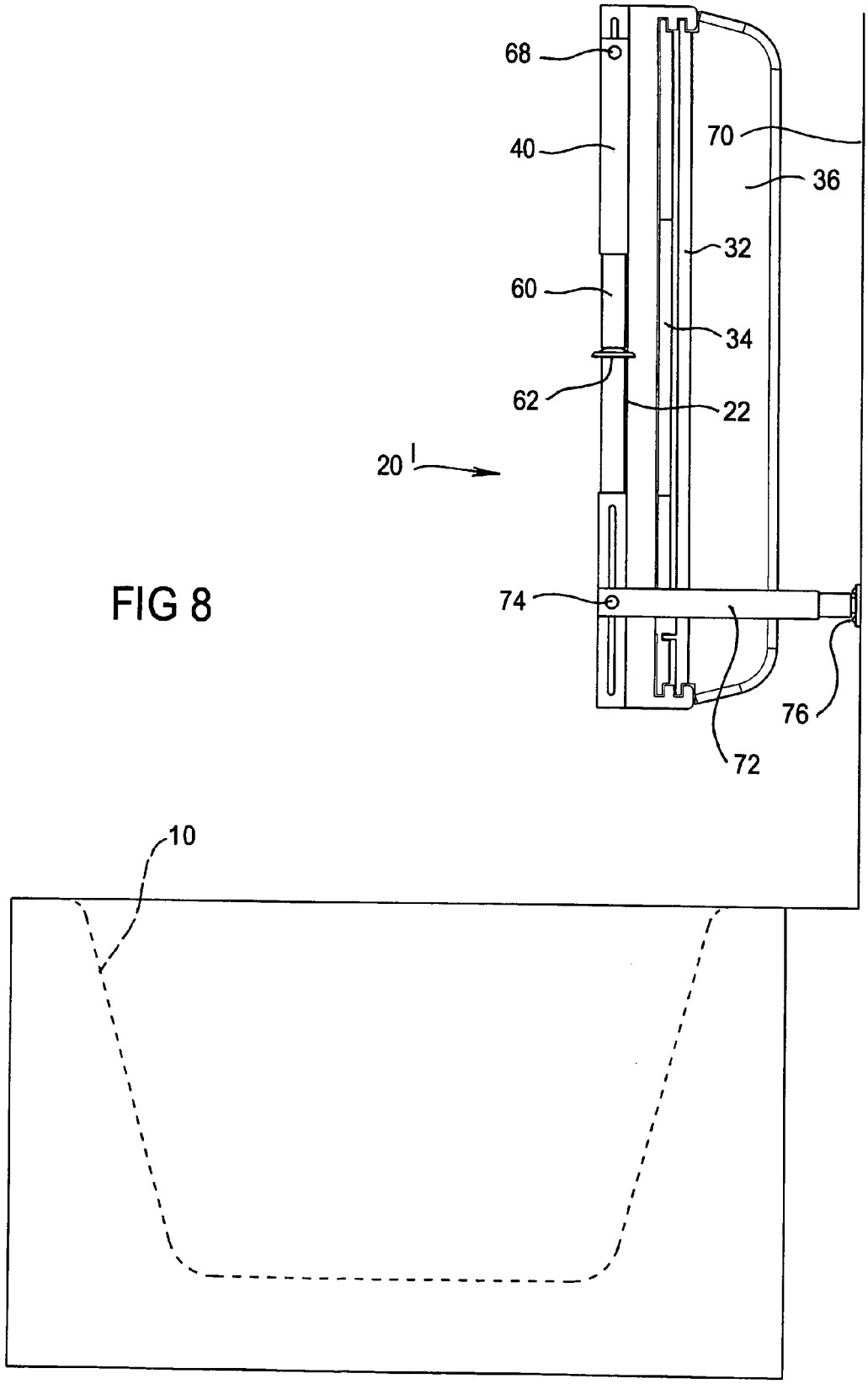
FIG. 8 shows the device of FIG. 7 in its storage position.

FIGS. 7 and 8 illustrate another embodiment of the invention, namely a fold-away device 20' which is a modified form of the device 20 already described. Components of the device 20' of FIGS. 7 and 8 which correspond with components of the device 20 of FIGS. 1 to 6 have been accorded the same reference numerals. The device 20' includes supports 40–60 with suction cups 62 pivotally mounted to panel structure 22 at 68 for supporting the device 20' on household bath tub 10 surround along its side opposite a wall 70. At its side adjacent the wall 70, the device 20' includes mounting means in the form of fixing supports 72 also pivotally mounted to panel 22 at 74. Fixing supports 72 are fixed to wall 70 at 76 in any suitable manner. Thus the device 20' is pivotal relative to the fixing supports 72, about pivotal mountings 74, to a storage position against or closely adjacent to the wall 70. Obviously the baby bath 26 is removed for storage of the device 20' and supports 40 are also pivotal about 68 to a storage position as shown in FIG. 8.

With reference to FIG. 1, it is evident that a household bathroom provides little free space for accommodating a stand alone baby change table. Furthermore, even when the space over a household bath tub 10 is utilized, as in the present teachings, the available space is still limited (for example household bath tubs are typically about 1500–1700 mm long), and if a toilet or vanity unit is located closely adjacent the accessible side of the bath tub, the full length of the bath tub won't be available for easy access. Thus the available space for accommodating all three of a work table, change table and baby bath or even only a change table and baby bath in relatively fixed positions is insufficient. The invention provides a solution to this difficulty by providing for relative sliding movement between the change table and the baby bath whilst allowing retention of a work table (if this is provided) beside the bath. According to the invention improved safety and convenience is provided by having the change table (and not the baby bath) as the slidably mounted component.

A device 20 or 20' according to the invention may be manufactured from light weight but strong materials, for example, the panel structure 22 and table tops 32 and 34 may be manufactured from suitable plastics materials, as may be the slidable mountings and supports. However other materials such as wood and/or metals may be used as may be suitable. It is also within the scope of the invention that a device 20 or 20' be sold to consumers as a kit of parts for assembly by a consumer.

The invention described herein is susceptible to variations, modifications and/or additions other than those specifically described and it is to be understood that the invention includes all such variations, modifications and/or additions which fall within the scope of the following claims.

What is claimed is:

1. A device for use with bathing and changing a baby comprising:

a structure for supporting a baby bath, and a table top or change table for supporting a baby slidably mounted on said structure for movement relative to a baby bath supported by said structure from a generally horizontal position next to the baby bath whereat the table top or change table is wholly supported by said structure to a position over the baby bath whereby in use a baby removed from the baby bath is placable on the change table and the change table is then slidable over the baby bath for safety, said structure including supports for supporting the device over a household bath tub.

2. A device for use with bathing and changing a baby comprising a structure for supporting a baby bath;

a table top or change table for supporting a baby slidably mounted on said structure for movement relative to a baby bath supported by said structure from a position next to the baby bath to a position over the baby bath;

said structure including supports for supporting the device over the household bath tub, the device including a second table top or work table mountable on said structure to be located adjacent the baby bath, the work table being for supporting accessories and for safely covering the household bath tub when a baby is on the change table beside or over the baby bath.

3. A device according to claim 2, wherein the work table is slidably mounted on said structure and is located between the change table and a baby bath supported by said structure and is movable relative to the baby bath from a position adjacent the baby bath to a position covering the baby bath.

4. A device according to claim 3 including a further table top or second work table mounted on said structure and located to be adjacent the baby bath, wherein the first defined work table is slidable to a position over the baby bath and thus beside the second work table, and wherein the change table is slidable at least part way across both work tables.

5. A device according to claim 4, wherein the second work table is slidably mounted on said structure and is located between the change table and the first defined work table.

6. A device according to claim 3, wherein the structure for supporting a baby bath is a planar body having an aperture within which the baby bath is locatable to be supported by the planar body, and wherein the planar body includes opposite side rails having slideways for slidably mounting the change table and at least one work table.

7. A device according to claim 2, including a further table top or second work table mountable on said structure to be located adjacent the baby bath opposite the first defined work table.

8. A device according to claim 2, wherein the supports are adjustable for varying the height of the change table over a household bath tub.

9. A device according to claim 8, including a support framework which provides said supports, wherein the framework is adjustable lengthwise and widthwise for supporting the device over household bath tubs of varying sizes.

10. A device according to claim 2, wherein the structure for supporting the baby bath includes mounting means for mounting the device to a wall adjacent a household bath tub, and wherein the device is pivotable relative to the mounting means for movement from a storage position against the wall to a use position over the household bath tub.

11. A device for use with bathing and changing a baby comprising:

a structure for supporting a baby bath;

a table top for supporting a baby slidably mounted on said structure for movement relative to a baby bath supported by said structure from a position next to the baby bath to a position over the baby bath said structure including supports for supporting the device over a household bath tub wherein the supports are adjustable for varying the height of the change table over the house hold bath tub and wherein the supports further include a support framework wherein the framework is adjustable lengthwise and widthwise for supporting the device over household bath tubs of varying size.

* * * * *